United States Patent [19]

Davis

[11] 4,041,349

[45] Aug. 9, 1977

[54] TRAVELLING WAVE TUBES

[75] Inventor: Peter Robert Davis, Chelmsford, England

[73] Assignee: English Electric Valve Company Limited, England

[21] Appl. No.: 658,826

[22] Filed: Feb. 17, 1976

[51] Int. Cl.[2] ..... H01J 25/34

[52] U.S. Cl. ..... 315/3.5; 315/5.35; 315/37.3

[58] Field of Search ..... 315/3.5, 5.35, 39.3

[56] References Cited

U.S. PATENT DOCUMENTS

| | | | |
|---|---|---|---|
| 2,305,884 | 12/1942 | Litton | 315/3.5 |
| 3,324,339 | 6/1967 | Winslow et al. | 315/3.5 X |
| 3,602,766 | 8/1971 | Grant | 315/3.5 |
| 3,668,459 | 6/1972 | Symons et al. | 315/3.5 |
| 3,684,914 | 8/1972 | Purnell | 315/3.5 |
| 3,885,192 | 5/1975 | Esterson et al. | 315/3.5 |
| 3,958,147 | 5/1976 | Triplett | 315/3.5 |

*Primary Examiner*—Saxfield Chatmon, Jr.
*Attorney, Agent, or Firm*—Diller, Brown, Ramik & Wight

[57] ABSTRACT

A travelling wave tube having cavities coupled for the fundamental mode uses a periodic permanent magnetic focussing structure. Ferromagnetic plates which carry the magnetic field to the electron beam path are provided with axial extensions adjacent to the electron beam to increase the magnetic field strength.

4 Claims, 3 Drawing Figures

TRAVELLING WAVE TUBES

Figure 1:
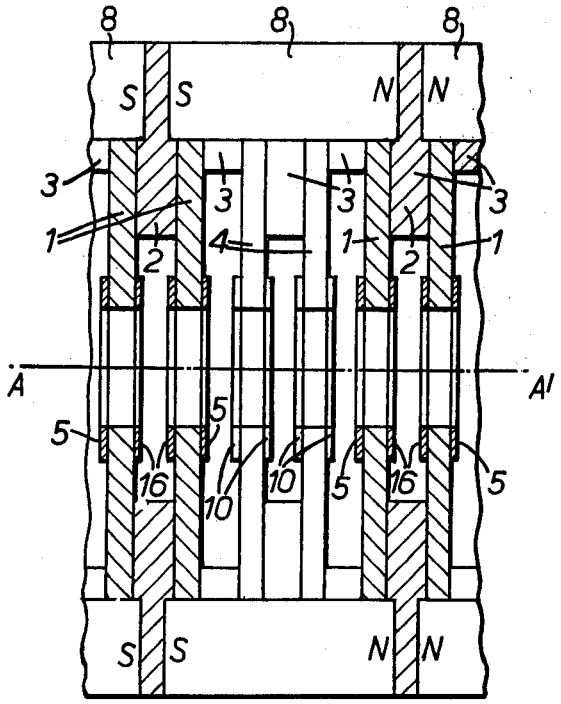

This invention relates to travelling wave tubes and is concerned with improvements in or modifications to the invention which is the subject of our co-pending parent patent application Ser. No. 442,884, now U.S. Pat. No. 3,885,192.

According to the parent invention a coupled cavity travelling wave tube includes a stack of apertured plates assembled to provide a plurality of successive coupled cavities coupled for the fundamental mode of operation; a magnetic pole piece provided at each nth cavity (where *n* is an integer of 2 or greater) which pole piece consists of an apertured plate made of ferromagnetic material and positioned between a pair of thinner apertured plates which also consist of ferromagnetic material and which have regions extending the ferromagnetic path, provided by the first mentioned apertured plate, close to the electron beam path of the tube, each pair of said thinner apertured plates being spaced apart from each other by the thickness of the first mentioned apertured plate to define a cavity between them; and a periodic permanent magnetic focusing structure surrounding said cavities and consisting of ring shaped magnets which provide permanent magnetic fields through said pole pieces to said electron beam path.

According to this invention a fundamental coupled cavity travelling wave tube includes a stack of apertured plates assembled to provide a plurality of successive coupled cavities coupled for the fundamental mode of operation; and a periodic permanent magnetic focusing structure surrounding said cavities and consisting of ring shaped magnets which provide permanent magnetic fields to the electron beam path of the tube through selected ferromagnetic ones of the stack of apertured plates which are provided with axial ferromagnetic extensions adjacent said beam path to increase the peak magentic field at said beam path.

Preferably the axial extensions comprise hollow annular cylinders positioned on both faces of said ferromagnetic plates.

Preferably the ferromagnetic material is soft iron.

Preferably again the said cylinders are disposed symmetrically on each face of said ferromagnetic plates.

Each ferromagnetic plate is provided with a central aperture through which the electron beam path passes, and radial slots which terminate at an inner diameter which is greater than the diameter of said central aperture. In such a case preferably each said cylinder extends from the central aperture to the inner diameter corresponding to the termination of said radial slots.

In order to preserve the electrical symmetry of the travelling wave tube the ferromagnetic plates are of the same thickness as other similar apertured plates which are wholly copper, and preferably those copper plates which are apertured in a manner similar to the selected ones of the ferromagnetic plates are each provided with axial copper extensions of the same shape and size as those ferromagnetic axial extensions provided for said selected ones of the ferromagnetic plates.

The effect of the ferromagnetic axial extensions is to increase the peak magnetic field in the region of the electron beam path, by providing a flux leakage path which is shorter than that provided at distances further away from the electron beam path.

Figure 2:
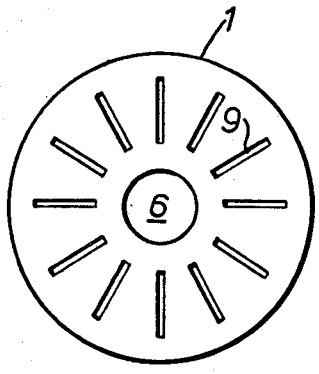
Figure 3:
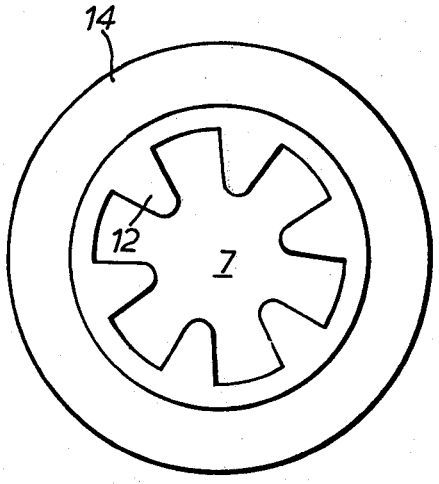

The invention is further described, by way of example, with reference to the accompanying drawings in which FIG. 1 is a diagrammatic section view taken on a centre line A A', showing one magnetic length of a permanent magnetic focusing arrangement in a travelling wave tube in accordance with the present invention, and FIGS. 2 and 3 show examples of the apertured plates which form the cavities of the travelling wave tube.

Referring to the drawings, a portion of a travelling wave tube consists of a stack of apertured plates 1,2,3,4, which are assembled together to provide a succession of cavities for the fundamental mode of operation. In FIG. 1 the plates which are shown cross-hatched are made of ferromagnetic material, usually soft iron and the unshaded plates are made wholly of copper. As can be seen the plates referenced 1 are each provided with a central hole 6 and radial slots 9. The plates 4 are identical except that they are made wholly of copper — they are not separately shown in front view.

The soft iron plates referenced 2, are shown in FIG. 3 and are like the plates 3 which are made of copper, except that each is provided with a rim-like extension 14 which serves to locate cylindrical ringlike magnets 8. The plates 2 act as pole pieces for these magnets 8. Each is provided with a large central aperture 7 having six inward projections 12.

The plates with the radial slots 9 (i.e. plates 1 and 4) are arranged so that the slots 9 in successive plates align with each other. However, the other apertured plates (i.e. plates 2 and 3) which are each provided with the six inward projections 12 are rotationally staggered (angularly offset) by 30° relative to the two adjacent similarly apertured plates 2 or 3.

The complete stack, which consists of many magnetic lengths of the kind shown in FIG. 1, is formed as a mechanical unit, to form with end members (not shown) a vacuum-tight structure, one end member carrying an axially positioned electron gun, and the other end member carrying an axially positioned electron collector.

As is pointed out in the parent U.S. Pat. No. 3,885,192 the plates 1 extend the magnetic field to the electron beam path of the tube. The plates 2 serve as pole pieces for the magnets 8, and their thickness is determined by the magnetic flux they are required to carry. The plates 1 are somewhat thinner, since the magnetic flux carried by them decreases with distance from the magnet 8. In practice the thickness of the rim-like extensions 14 is at least two and a half times as thick as the thickest section of the plates 1 to prevent magnetic saturation. This kind of structure provides a very compact and light travelling wave tube.

The central regions of plates 1 i.e. the regions adjacent to the central aperture 6, are provided with short lengths of hollow cylinders 5 which extend along the axis A A' of the electron beam path. In practice the cylinders 5 could conveniently consist of planar washers affixed by brazing to each plate 1 to ensure good thermal and electrical contact therewith. These cylinders, like the plates 1, consist of soft iron, and their purpose is to reduce the magnetic path between plates 1 associated with opposite ends of each ring magnet 8, so as to increase the magnetic field strength in the region of the electron beam path.

In order to preserve the electrical symmetry of the focusing structure so as not to adversely affect the coupling properties of the cavities similarly dimensioned soft iron cylinders 16 are affixed to the remaining face of each of the plates 1 and copper cylinders 10 are affixed to both faces of the copper plates 4 as shown. Cylinders 16 and 10 are also mounted so as to be in good thermal and electrical contact with the plates to which they are fixed for example by brazing.

Typically the thickness of the plates 1 and 4 is about 2 mm and the thickness of each cylinder (i.e. its axial length) is about 1 mm. The presence of the cylinders may require a small alteration to the length of the slots 9 to maintain optimum coupling between the cavities.

In use an electron beam is projected along the centre of the travelling wave tube and its path corresponds to the line A A'. The ring magnets 8, which are alternately poled as shown, serve to focus this electron beam, and to counter-act its tendency to spread.

It has previously been believed that the satisfactory operation of a travelling wave tube in the fundamental mode (as opposed to the more usual space harmonic mode of operation) required that the thickness of the plates 1 and 4 should be very thin at the region of the electron beam path. Indeed from some theoretical considerations the plates should become infinitely thin as they approach the electron beam path, and in U.S. Pat. 3,885,192, FIGS. 3, 5 and 6 illustrate such plates in which the thickness is decreased towards the axis A A'. The present invention resides, therefore, in the rather surprising discovery that, contrary to predictions, the axial extensions 5, 16, 10 do not significantly adversely affect the fundamental mode of operation of a travelling wave tube, thereby permitting the peak magnetic field to be increased to a greater value than would otherwise be the case.

I claim:

1. A coupled cavity travelling wave tube including a stack of alternately slotted and apertured plates assembled to provide a plurality of successive coupled cavities coupled for the fundamental mode of operation; a magnetic pole piece provided at each nth cavity (where n is an integer greater than 2), which pole piece consists of an apertured plate made of ferromagnetic material and positioned between a pair of thinner slotted plates which also consist of ferromagnetic material and which have regions extending the ferromagnetic path, provided by the first mentioned apertured plate, close to the electron beam path of the tube, each pair of said thinner slotted plates being spaced apart from each other by the thickness of the first mentioned apertured plate to define a cavity between them; a periodic permenent magnetic focussing structure surrounding said stack and consisting of ring shaped magnets which provide permanent magnetic fields through said pole pieces to said electron beam path, means axially thickening the central portions of said slotted plates in surrounding relation to the apertures of said apertured plates.

2. A travelling wave tube as defined in claim 1 wherein said means comprises a pair of annular washers sandwiching said slotted plates therebetween, said washers being of a combined thickness about equal to the thickness of a slotted plate.

3. In a fundamental coupled cavity travelling wave tube, in combination:

a stack of plates comprising a set of apertured plates each having an outer, rim-like portion and a plurality of radially inwardly directed projections whose tips define a minimum diameter of its aperature and a set of slotted plates having central openings which are of much smaller diameter than said minimum diameter of the aperatured plates, said apertured and slotted plates being alternated in said stack so that each apertured plate is sandwiched between two of said slotted plates and a cavity is defined between the two slotted plates sandwiching each apertured plate, each slotted plate having slots coupling the cavities with which it is associated and the slots of all of said slotted plates being aligned while the projections of said apertured plates are rotationally staggered sequentially through said stack to provide the fundamental coupled cavity structure; and a periodic permanent magnet focussing structure integrated with said stack and comprising a magnetic pole structure at every nth cavity, where n is at least 3, and a ring-like permanent magnet associated with each pair of pole structures, each pole structure comprising an apertured plate having its rim-like portion of extended outer diameter and with at least such rim-like portion being of ferromagnetic material and a pair of slotted plates of ferromagnetic material sandwiching such apertured plate therebetween, the apertured plates and slotted plates which do not form pole structures being formed of electrically conductive, non-magnetic material and having outer diameters lying on a cylinderical surface from which said extended rim-like portions project, each ring-like permanent magnet embracing said cylindrical surface between a pair of pole structures and having opposite pole faces engaging the extended rim-like portions of such pair of pole structures, means axially thickening the central portions of said slotted plates in surrounding relation to said central openings thereof.

4. In a travelling wave tube as defined in claim 3 wherein said means comprises a pair of annular washers sandwiching said slotted plates therebetween, said washers being of a combined thickness about equal to the thickness of a slotted plate.

* * * * *